United States Patent [19]

Nakamura et al.

[11] 4,308,018

[45] Dec. 29, 1981

[54] TRIM-TILT DEVICE FOR MARINE PROPULSION DEVICES

[75] Inventors: Tamotsu Nakamura; Hideo Suzuki, both of Iwata, Japan

[73] Assignee: Showa Manufacturing Co., Ltd., Tokyo, Japan

[21] Appl. No.: 40,737

[22] Filed: May 21, 1979

[30] Foreign Application Priority Data

Jun. 2, 1978 [JP] Japan ..... 53/65721

[51] Int. Cl.[3] ..... F01B 7/02; F01B 7/10; F01B 15/04; F15B 15/22

[52] U.S. Cl. ..... 440/61; 91/189 R; 91/401; 92/65; 92/75; 92/118

[58] Field of Search ..... 91/401, 189 R; 92/65, 92/75, 117 A, 118, 62; 440/61

[56] References Cited

U.S. PATENT DOCUMENTS 2,261,444 11/1941 Neubert, Jr. ..... 91/401
3,446,307 5/1969 Logus ..... 92/65
3,631,760 1/1972 Moran ..... 92/65

FOREIGN PATENT DOCUMENTS 1228058 4/1971 United Kingdom ..... 92/65

*Primary Examiner*—Paul E. Maslousky
*Attorney, Agent, or Firm*—A. W. Breiner

[57] ABSTRACT

A trim-tilt device for marine propulsion devices wherein a cylinder and a piston rod slidably fitted in the cylinder are provided to be connected respectively with a propulsion device which in turn is connected to a hull so as to be rotatable in a vertical plane, and with the hull. A tilt piston is fitted to the tip of the piston rod and a free piston is arranged on the bottom side of the cylinder as opposed to the tilt piston and a trim piston is fitted to the tip of a pipe slidably fitted to the above mentioned piston rod. The trim piston is arranged on the opposite side of the tilt piston as opposed to the free piston and is slidably fitted in the above mentioned cylinder. Oil inlet and outlet ports are provided at both ends of the cylinder Stoppers and check valves are provided for controlling the oil pressure within the piston and cylinder arrangement. The trim-tilt device permits a trimming and tilting operation with a single cylinder.

7 Claims, 2 Drawing Figures

TRIM-TILT DEVICE FOR MARINE PROPULSION DEVICES

BACKGROUND OF THE INVENTION

1. Field of the Invention

This invention relates to trim-tilt devices for marine propulsion devices.

2. Description of the Prior Art

In a particularly small boat such as a motorboat, an engine and screw are integrally formed to be a propulsion device and this propulsion device is fitted to the hull so as to be rotatable in a vertical plane. That is to say, at the time of the operation of the propulsion device, a trimming operation for setting the screw at a proper angle in response to the mounted weight will be made so that a desired speed may be obtained and, in the case of pulling the hull up out of the water onto the land, a tilting operation for lifting the screw above the water surface is made to prevent the screw from being broken. U.S. Pat. No. 3,962,955 describes this type of device. However, in this patent, separate oil pressure cylinders are used for the trimming operation and tilting operation and therefore the device is complicated, large and heavy.

SUMMARY OF THE INVENTION

An object of the present invention is to eliminate the above mentioned defects and to provide a device which will permit the trimming and tilting operations with a single oil pressure cylinder and which also has a cushioning action.

The feature of the trim-tilt device according to the present invention is to comprise:

(a) a cylinder and a piston rod connected respectively with a propulsion device which in turn is connected to a hull so as to be rotatable in a vertical plane, and with the hull;

(b) fitted slidably within the cylinder:

(i) a tilt piston fitted to the tip of the piston rod, the tilt piston having a pair of check valves which can be opened only in the directions opposed to each other;

(ii) a free piston arranged on the bottom side of the cylinder, the free piston having a check valve which can be opened only to the tilt piston side from the cylinder bottom side;

(iii) a trim piston fitted to the tip of a pipe slidably fitted to the piston rod, the trim piston having a relief valve which can be opened from the end of the cylinder;

(c) oil inlet and outlet ports provided at both ends of the cylinder;

(d) stopper means for regulating the movements of the piston rod and pipe.

DETAILED DESCRIPTION OF PREFERRED EMBODIMENTS

Figure 1:
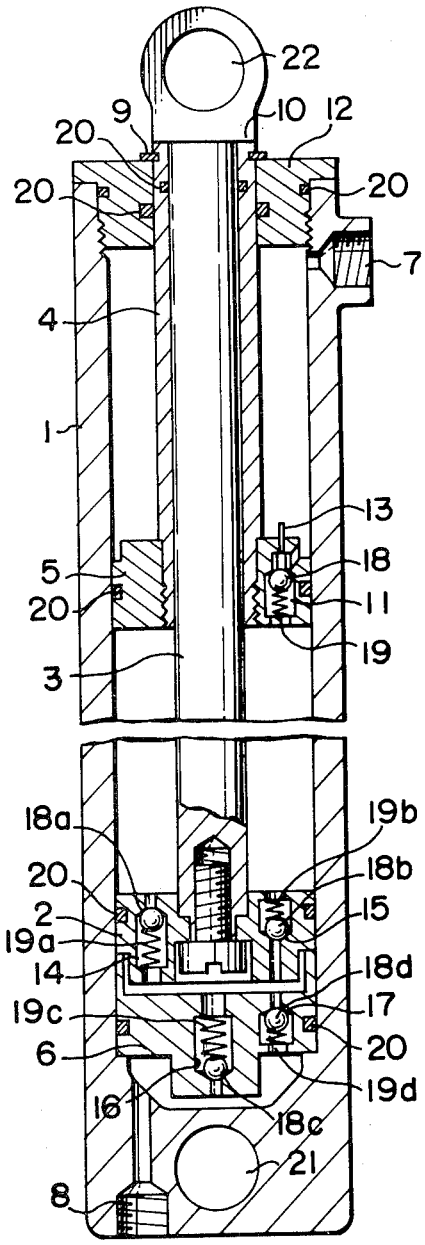
FIG. 1 is a vertically sectioned view of a trim-tilt device for marine propulsion devices embodying the present invention.

FIG. 1 is a vertically sectioned view of an embodiment of the present invention. A tilt piston 2 is slidably fitted in a cylinder 1, its piston rod 3 is pulled out of one end of said cylinder, a trim piston 5 is fitted to the tip of a pipe 4 slidably fitted to the rod 3 and a free piston 6 is provided on the opposite side of the trim piston 5 as opposed to the above mentioned tilt piston 2, that is, between the tilt piston 2 and the bottom of the cylinder 1.

Inlet and outlet ports 7 and 8 are formed at both ends of the cylinder 1, a stopper 9 for limiting the distance for which the trim piston 5 moves to the bottom side of the cylinder 1 is provided at the base end of the pipe 4 and a stopper 10 for preventing the escape of said pipe 4 is formed in the piston rod 3. A relief valve 11 which will open when the oil pressure between the above mentioned trim piston 5 and the oil inlet and outlet port 7 has become higher than a predetermined value and a relief pin 13 which will be pushed by rod guide 12 to open the above mentioned valve 11 when this trim piston 5 has approached the rod guide 12 are provided in said trim piston 5.

Further, a check valve 14 which will open when the oil pressure between this tilt piston and trim piston 5 has risen to be higher by a predetermined value than the oil pressure between the tilt piston and free piston and a check valve 15 which will open in case the oil pressure between the tilt piston and free piston has become slightly higher are provided in the tilt piston 2. A check valve 16 which will open when the oil pressure between the free piston 6 and the bottom of the cylinder 1 has reached a proper valve Pc and a safety valve 17 which will open when the oil pressure between the free piston and tilt piston has risen remarkably are provided in the free piston 6. It is to be understood that in the above described relief valve, check valves and safety valves, steel balls 18, 18*a*, 18*b*, 18*c* and 18*d* are respectively provided against the valve seats of oil holes and are, as required, pressed with respective springs 19, 19*a*, 19*b*, 19*c* and 19*d*. An O-ring 20 is fitted to each of the pistons and piston rod. Fitting holes 21 and 22 are formed respectively at the base ends of the cylinder 1 and piston rod 3.

Figure 2:
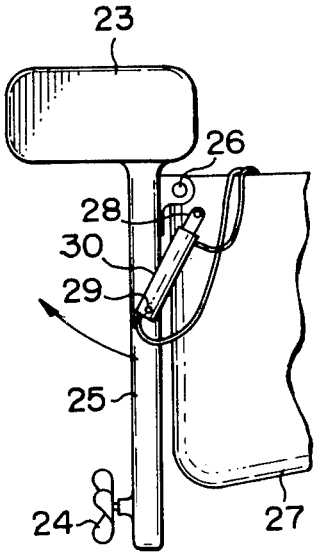
FIG. 2 is a side view showing the device shown in FIG. 1 as fitted to a ship.

FIG. 2 is a side view of the above described device as fitted to a boat. This is to say, an engine 23 and a screw 24 are integrally formed to be a propulsion device 25. This propulsion device 25 is connected to the tail portion of a hull 27 through a shaft 26 so as to be freely rotatable in a vertical plane. The piston rod 3 and cylinder 1 are fitted respectively to the above mentioned hull 27 and propulsion device 25 through shafts 28 and 29. Therefore, when the above described device 30 extends, the propulsion device 25 will rotate as indicated by the arrow to make a trimming or tilting operation.

In the above described device, while the engine 23 is stopped, the piston rod 3 will be pushed downward in FIG. 1 by only the force Pa corresponding to the weight of the propulsion device 25. In this state, if an oil pressure is fed into the oil inlet and outlet port 8 in the bottom of the cylinder 1, as the oil pressure Pc opening the valve 16 is made higher than the oil pressure Pa corresponding to the above mentioned force, the free piston 6 will move upward in the drawing to push up the piston 2. As the valve 14 also remains closed, the trim piston 5 will also move upward while keeping a fixed distance between it and the tilt piston 2. However, when the trim piston 5 has approached the guide 12, the relief pin 13 will be pushed to open the valve 11, therefore the oil between the trim piston 5 and tilt piston 2 will be discharged through the oil inlet and outlet port 7 and said tilt piston will further move upward until the guide 12, trim piston 5 and and tilt piston 2 overlap together.

In this state, when the oil pressure below the free piston 6 has risen to reach the pressure Pc, the valve 16 will open, therefore the oil fed in through the oil inlet and outlet port 8 will be discharged through the oil inlet and outlet port 7 through the valves 16, 15 and 11 and the pistons 5, 2 and 6 will remain overlapped together as described above. When the oil is fed in through the oil inlet and outlet port 7, it will come in between the trim piston 5 and tilt piston 2 through the relief valve 11 but, as the valve 14 remains closed, only the tilt piston 2 and free piston 6 will move downward in the drawing and, when the stopper 10 contacts the base end of the pipe 4, the trim piston 5 will be also pushed downward to separate from the guide 12 and the relief valve 11 will close. Therefore, the trim piston 5 will move downward in the drawing, the tilt piston 2 will also move while keeping a fixed distance between it and the above mentioned trim piston and therefore the state in the drawing will return. However, if the oil is further fed in through the oil inlet and outlet port 7, with the rise of the oil pressure, the relief valve 11 will again open, further the valves 14 and 17 will open and therefore the oil fed in will be discharged through the oil inlet and outlet port 8. When the tilt piston 2 has moved to a desired position, if the valve of an oil conduit pipe connected to the oil inlet and outlet port 7 is closed, said piston will be fixed in that position. That is to say, while the propulsion device is stopped, the piston rod 3 will be able to be moved over the entire range of its stroke and to be fixed in any position. By this tilting operation, the propulsion device 25 in FIG. 2 will be rotated as indicated by the arrow from the state in the drawing to move to be substantially horizontal and to be fixed in a desired position on the way.

If the propulsion device 25 is lowered to be as in FIG. 2 and the screw 24 is rotated, the piston rod 3 will be pushed downward in FIG. 1 with a force corresponding to the sum of the weight of said propulsion device and the propulsion of the boat by the rotation of the screw. In this state, if the pressure oil is fed in through the oil inlet and outlet port 8, as the above mentioned force is large, even if the oil pressure exceeds the oil pressure Pc at which the valve 16 is to open, the free piston 6 will remain stopped. Therefore, with the rise of the oil pressure between the free piston 6 and the bottom of the cylinder 1, the valve 16 will first open, the valve 15 of the tilt piston 2 will open therewith and therefore the above mentioned oil pressure will be applied to the piston 5. When the oil pressure exceeds the valve Pb corresponding to the force applied to the piston rod 3, the trim piston 5 will begin to move upward in the drawing. Therefore, the piston rod 3 will be also simultaneously pulled upward and the propulsion device 25 will rotate as indicated by the arrow in FIG. 2. With this rotation, the propulsion will vary. Therefore, when the ship has reached a desired speed, if the valve of the conduit pipe connected to the oil inlet and outlet port is closed, the trim piston 5 will be fixed in that position. If the above mentioned valve is left open, when the trim piston 5 contacts the guide 12, the relief pin 13 will be pushed to open the valve 11. Therefore, the oil fed in through the oil inlet and outlet port 8 will be discharged through the oil inlet and outlet port 7, the rise of the oil pressure will stop and the movement of the piston rod 3 will also stop. That is to say, in this case, the adjustable angle range of the propulsion device 25 will be limited by the range in which the trim piston 5 can move toward the bottom of the cylinder 1 and the trimming operation will be made as described above.

Further, when the ship is running with the propulsion device set at a proper trimming angle by the trimming operation, if said propulsion device collides in the lower part with an obstacle in the water, a shock upward in FIG. 1 will be applied to the piston rod 3. Therefore, the oil pressure between the tilt piston 2 and trim piston 5 will rise. When this oil pressure exceeds a certain valve, the check valve 14 will open and the oil between the above mentioned two pistons will flow in between the tilt piston 2 and free piston 6. Therefore, when the piston rod 3 moves upward in FIG. 1 and the oil flows through the oil hole of the piston 2, a damping force will be generated to make a cushioning action. When the above described shocking force vanishes, the piston rod 3 will be pushed downward in FIG. 1 by the force corresponding to the weight of the propulsion device and the propulsion of the ship. Therefore, the check valve 15 of the tilt piston 2 will open, this tilt piston 2 will move downward and the original position in which the pressure on both sides are substantially balanced will return. It is to be understood that in case the shock force applied to the piston rod 3 is very large, the tilt piston 2 will collide with the trim piston 5 to greatly elevate the oil pressure above it. Therefore, the relief valve 11 will open, the trim piston 5 will move upward in FIG. 1, therefore the oil will flow through the above mentioned relief valve 11 and valve 14 and thereby a large damping force will be generated. However, in this case, even after the shock force vanishes, the trim piston will have no returning action and therefore it will be necessary to make the above described trimming operation to set the propulsion device at a desired angle.

As explained above, in the device of the present invention, a trimming operation and tilting operation of a propulsion device of a boat can be made with a single oil pressure cylinder and, when the propulsion device collides with an obstacle while the boat is running, the breakage of the propulsion device will be prevented by the cushioning action. Therefore, the propulsion device of the boat can be formed to be simple, small and light and the operation is easy.

What we claim is:

1. A trim-tilt device for marine propulsion devices comprising:

(a) a cylinder having an upper and lower end and a piston rod having first and second ends, the lower end of said cylinder and the first end of said piston rod connected respectively with a propulsion device which in turn is connected to a hull so as to be rotatable in a vertical plane, and with said hull;

(b) fitted slidably within said cylinder:

(i) a tilt piston fitted to the second end of said piston rod, said tilt piston having a pair of check valves which can be opened only in the directions opposed to each other;

(ii) a free piston arranged between the lower end of said cylinder and said tilt piston, said free piston having a check valve which can be opened only in the direction toward said tilt piston;

(iii) a trim piston fitted to the tip end of a pipe having a tip and base end slidably fitted to said piston rod, said trim piston having a relief valve which is opened when contacted with the upper end of said cylinder;

(c) an oil inlet and outlet port provided at each end of the cylinder;

(d) stopper means for regulating the movements of the piston rod and pipe.

2. The device according to claim 1 wherein said free piston is further provided with a safety valve which will open when the oil pressure between the free piston and tilt piston has risen abnormally.

3. The device according to claim 1 wherein each of said check valves comprises an oil hole passing through its associated piston, a valve seat provided within the oil hole and a steel ball provided against the valve seat.

4. The device according to claim 3 having a means of pressing said steel ball against the valve seat.

5. The device according to claim 1 wherein said relief valve comprises an oil hole passing through the trim piston, a valve seat provided within the oil hole, a spring pressing the steel ball against the valve seat and a pin project at one end out of the trim piston and engaging at the other end with the steel ball.

6. The device according to claim 1 wherein said stopper means for the piston rod is provided at the base end of said pipe to limit the distance in which the trim piston moves toward the lower end of the cylinder.

7. The device according to claim 1 wherein said stopper means for the pipe is provided at the first end of the piston rod to prevent the escape of the pipe.

* * * * *